United States Patent [19]

Radway

[11] Patent Number: 4,614,343

[45] Date of Patent: Sep. 30, 1986

[54] GOLF SWING TRAINING DEVICE

[75] Inventor: Ronald F. Radway, Okemos, Mich.

[73] Assignee: Snapper, Inc., Lansing, Mich.

[21] Appl. No.: 700,473

[22] Filed: Feb. 11, 1985

[51] Int. Cl.[4] ..... A63B 69/36

[52] U.S. Cl. ..... 273/186 A; 273/80.8; 273/80.6

[58] Field of Search ..... 273/186 A, 26 B, 29 A, 273/193 R, 193 A, 194 B

[56] References Cited

U.S. PATENT DOCUMENTS

| | | | |
|---|---|---|---|
| Re. 28,661 | 12/1975 | Tredway | 273/183 B |
| 1,854,392 | 4/1932 | Rambrick | 273/191 A |
| 2,064,603 | 12/1936 | Harrison | 273/183 B X |
| 2,191,683 | 2/1940 | Roberts | 273/183 B |
| 2,388,463 | 11/1945 | Benecke | 273/186 A |
| 2,543,722 | 2/1951 | Hetzel | 273/186 A |
| 2,772,887 | 12/1956 | Blake | 273/186 A |
| 3,116,926 | 1/1964 | Owen et al. | 273/171 |
| 3,136,546 | 6/1964 | Connolly | 273/186 A |
| 3,575,419 | 4/1971 | Davis | 273/193 X |
| 3,792,863 | 2/1974 | Evans | 273/186 A |
| 3,808,707 | 5/1974 | Fink | 273/186 R |
| 3,861,688 | 1/1975 | Butler | 273/186 A |
| 3,953,034 | 4/1976 | Nelson | 273/186 C |

*Primary Examiner*—George J. Marlo
*Attorney, Agent, or Firm*—George P. Pappas

[57] ABSTRACT

A golf swing training device comprising an elongate golf club shaft provided with a golf club hand grip at the upper end thereof and a weighted mechanical head assembly fixedly connected to the lower end thereof. The shaft is connected to the mechanical head assembly by an improved connector assembly. The mechanical head assembly comprises a spring biased weighted cartridge member positioned within a barrel housing and provided with snap ring-engaging fingers extending outwardly through slots provided in the barrel housing. The barrel housing is provided with an adjustable head closure member at the lower end thereof which is adapted to selectively increase or decrease tension of the cartridge-engaging main spring contained in the barrel housing. A cartridge-engaging main spring is positioned within the barrel housing by use of upper and lower locator bearings. A snap ring is provided for selective slidable movement along the external surface of the barrel housing and is retained at the upper portion thereof by the cartridge snap ring-engaging fingers which extend through the slots of the barrel housing when the golf swing training device is not in use. Upon execution of a properly executed golf swing, the resultant centrifugal force causes the spring loaded weighted cartridge to move downwardly within the barrel so as to cause the snap ring-engaging fingers to retract within the barrel, thereby releasing the snap ring which proceeds downwardly along the outer surface of the barrel at a high rate of speed until it collides with the edge of the adjustable head housing so as to produce a loud snap and a resultant physical feeling as if a golf club had properly struck a golf ball.

5 Claims, 10 Drawing Figures

GOLF SWING TRAINING DEVICE

This invention relates to an improved golf swing training device and more particularly to a golf swing training device which enables a golf instructor to demonstrate the proper hand action by correct use of the golf swing training device and further to allow a student to feel as well as hear a proper release. The improved golf swing device comprises an elongate golf club shaft which is provided with a mechanical head assembly at the outer end thereof. The shaft is connected to the mechanical head assembly by an improved connector assembly. The mechanical head assembly comprises a spring biased weighted cartridge member positioned within a barrel housing and provided with snap ring-engaging fingers extending outwardly through slots provided in the barrel housing. The barrel housing is provided with an adjustable head closure member at the lower end thereof which is adapted to selectively increase or decrease tension of the cartridge-engaging main spring contained in the barrel housing. The improved cartridge-engaging main spring is positioned within the barrel housing by use of upper and lower locator bearings. A snap ring is provided for selective slidable movement along the external surface of the barrel housing and is retained at the upper portion thereof by the cartridge snap ring-engaging fingers which extend through the slots of the barrel housing when the golf swing training device is not in use. When the golfer swings the golf swing training device properly with correct hand action, the spring loaded cartridge moves downwardly within the barrel so as to cause the snap ring-engaging fingers to retract within the barrel, thereby releasing the snap ring which proceeds downwardly along the outer surface of the barrel at a high rate of speed until it collides with the edge of the adjustable head closure member so as to produce a loud snap and a resultant physical feeling as if a golf club has properly struck a golf ball.

None of the golf practice devices of the prior known art provide a golf swing training device such as is found in this invention whereby a golfer is able to teach himself the proper hand action after demonstration by a golf instructor. Further, none of the devices of the prior known art provide a golf swing training device such as is found in this invention which constitutes an exerciser which strengthens golf-related muscles and builds golf-related muscle memory. In addition, none of the devices of the prior known art provide a golf swing training device such as the structure of this invention whereby an adjustable power setting capability is provided which enables the golfer to gradually increase the power of his swing. Finally, none of the golf practice devices of the prior known art provide a golf swing training device such as the structure of this invention whereby a correct swing is indicated by a loud snap and a simultaneous resultant physical feeling as if a golf club had struck a golf ball.

It is important to understand that the failure of a golfer to swing properly and therefore to not hear the snap and feel the correct release of the hands is a powerful reminder of precisely what a golfer must do to execute correctly. The concept that an improper swing will *not* be rewarded with a loud snap and a physical sensation as if a ball was struck is an important part of the design concept of this device. A failure to swing correctly has as much training impact as a correct swing.

A need has existed for a golf swing training device which enables a golf instructor to develop in a student a proper golf swing by achieving proper hand action, swing tempo and timing.

Another need has existed for a golf swing training device which enables a golfer to recognize that a proper golf swing has been achieved by signaling a loud snap at the bottom of the golf swing while simultaneously providing a resultant physical feeling as if a golf club has struck a golf ball.

Another need has existed for a golf swing training device which has an adjustable power setting capability which enables the golfer to gradually increase the power of his swing by repetitive training swings at selectively increased power settings.

It is therefore an object of this invention to provide a golf swing training device which enables a golfer to develop a proper golf swing by achieving proper hand action, swing tempo and timing.

Another object of the invention is to provide a golf swing training device which constitutes an exerciser that enables a golfer to strengthen his golf-related muscles and build golf-related muscle memory.

Yet another object of the invention is to provide a golf swing training device which enables a golfer to recognize that a proper golf swing has been achieved by signaling a loud snap at the bottom of the swing while simultaneously providing a resultant physical feeling as if a golf club has struck a golf ball.

Another object of this invention is to provide a golf swing training device which has an adjustable power setting capability which enables the golfer to gradually increase the power of his swing by repetitive training swings at selectively increased power settings.

Another object of this invention is to provide an improved golf swing training device whereby the shaft is uniquely connected to the weighted mechanical head assembly so as to minimize any tendency to develop a loose connection through repetitive use.

Yet another object of this invention is to provide an improved cartridge-engaging main spring which is uniquely positioned within the barrel housing by use of upper and lower locator bearings which enables the spring to provide accurate repetitive power action at selected power settings.

Other objects and advantages found in the construction of the invention will be apparent from a consideration of the following specification in connection with the appended claims and the accompanying drawings.

IN THE DRAWINGS

Figure 2:
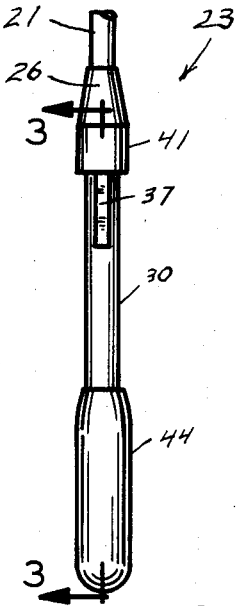
FIG. 2 is an enlarged partial schematic view of the mechanical head assembly provided at the lower end of the golf swing training device.
Figure 3:
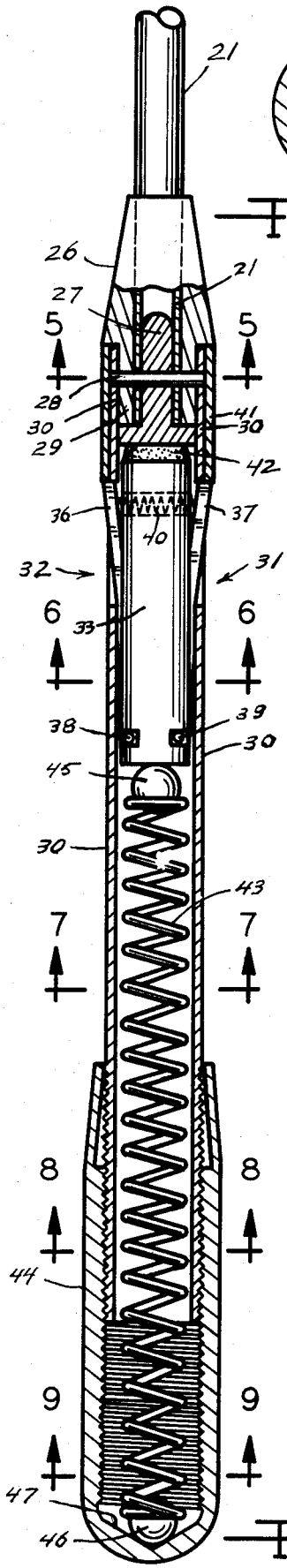

FIG. 3 is an enlarged partial schematic cross-sectional view of the golf swing training device taken on line 3—3 of FIG. 2 showing the weighted cartridge member in its spring loaded raised rest position within the barrel housing with the snap fingers in their expanded rest position extending through the slots in the barrel housing so as to engage and retain the snap ring in its raised position on the external surface of the barrel housing and further showing the unique shaft connector assembly and showing the main spring in operating engagement with the upper and lower locator bearings.

Figure 4:
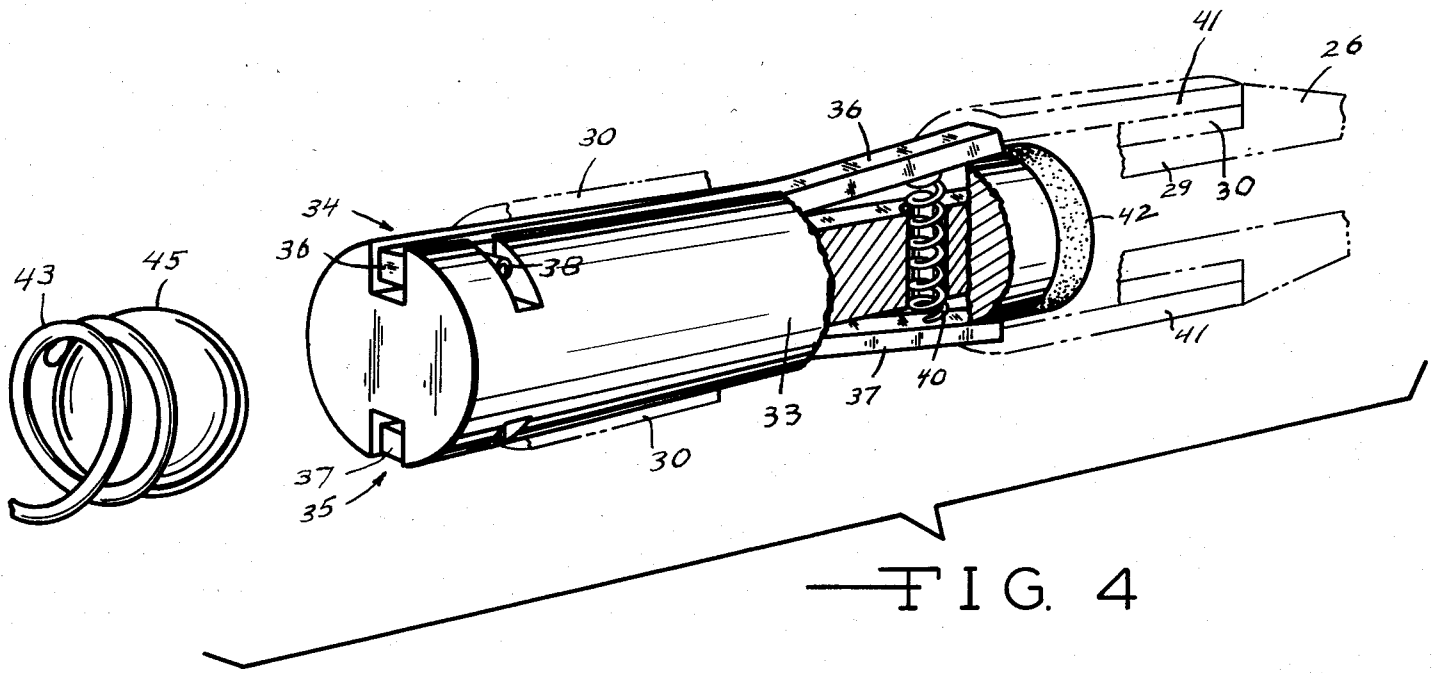

FIG. 4 is an enlarged partial schematic exploded perspective view of the cartridge member with a portion broken away to show the spring-loaded snap fingers pivotally positioned therein.

Figure 5:
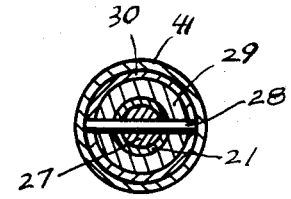

FIG. 5 is a cross-sectional view taken on line 5—5 of FIG. 3 showing the unique shaft connector assembly and the relative position of the snap ring on the external surface of the barrel housing.

Figure 6:
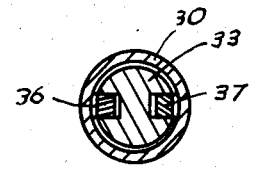

FIG. 6 is a cross-sectional view taken on line 6—6 of FIG. 3 showing the relative position of the weighted cartridge member within the barrel housing.

Figure 7:
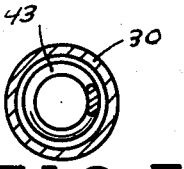

FIG. 7 is a cross-sectional view taken on line 7—7 of FIG. 3 showing the relative position of the main spring within the barrel housing.

Figure 8:
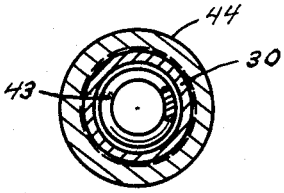

FIG. 8 is a cross-sectional view taken on line 8—8 of FIG. 3 showing the relative position of adjustable head member to the barrel housing member.

Figure 9:
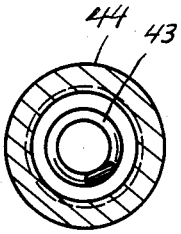

FIG. 9 is a cross-sectional view taken on line 9—9 of FIG. 3 showing the relative position of the main spring within the adjustable head member.

Figure 10:
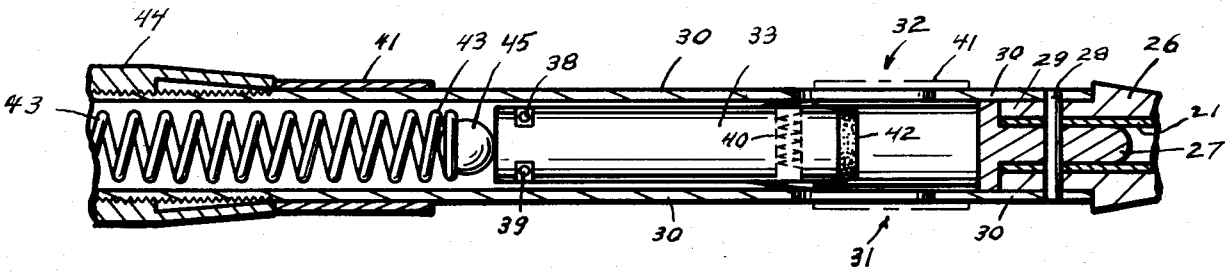

FIG. 10 is an enlarged partial schematic view of the golf swing training device showing the shaft connector assembly and cartridge member in its spring-loaded lowered centrifugal force-actuated position within the barrel housing with the snap fingers in their retracted compressed position within the barrel housing and further showing the snap ring moved to its snap sound producing position against the edge of the adjustable head member.

SPECIFIC DESCRIPTION

Figure 1:
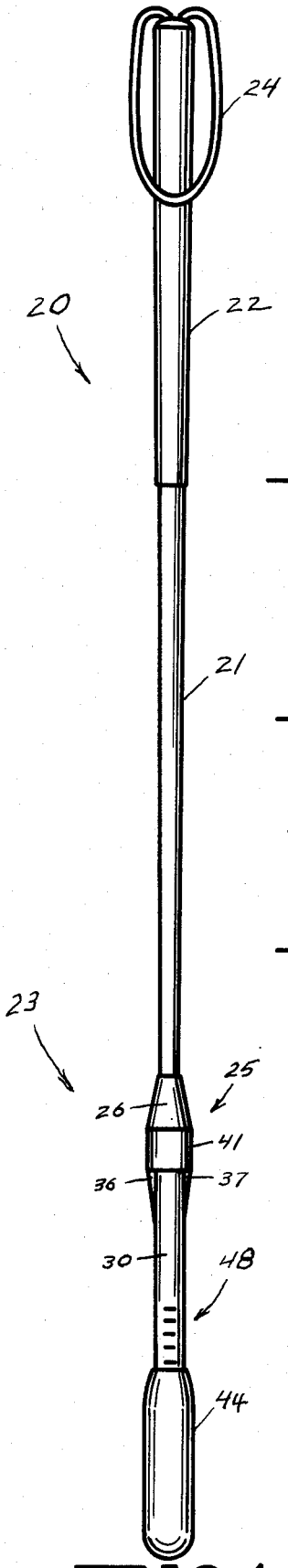
FIG. 1 is an elevational view of the golf swing training device showing the weighted mechanical head assembly at the lower end thereof and showing the power setting indicators on the lower outer surface of the barrel housing.

As shown in FIG. 1, a golf swing training and exerciser device 20 is provided which consists of a flexible hollow golf club shaft 21 provided with a deluxe golf hand grip portion 22 at one end thereof and a mechanical head assembly 23 at the opposite or lower end of the golf club shaft 21. The flexible golf club shaft 21 is a flexible hollow steel composite shaft of a type well known in the art. The deluxe golf grip 22 is also fabricated from materials well known in the art and is not considered an integral part of the invention. A wrist strap 24 is provided at the top of the golf grip 22 so as to selectively encircle the wrist of the golfer as an added safety feature when the golfer is swinging the golf swing training device.

As shown in FIGS. 2, 3 and 10, the mechanical head assembly 23 is affixed to the shaft 21 by use of a unique shaft connector assembly 25. The shaft connector assembly 25 comprises a collar member 26, a longitudinally oriented expander pin 27 and a transverse spring pin 28. The collar 26 is provided with a shaft receiving longitudinal bore therethrough. The hollow shaft 21 is press fitted to the collar 26 and extends therethrough. The expander pin 27 is inserted into the end of the shaft 21 so as to spread the end of the shaft 21 against the internal surface of the collar member 26 so that the connection does not loosen through extended use. The lower end of the collar member 26 has a downwardly extending neck portion 29 which is press fitted into the end of the barrel housing 30. A transverse hole is then drilled through the barrel housing 30, collar 26, shaft 21 and expander pin 27. The transverse spring pin 28 is inserted therethrough for additional safety and strength so as to positively maintain the barrel housing 30, the collar member 26, the hollow shaft 21 and the expander pin 27 in a permanent, fixed mating engagement with each other.

The upper end of the barrel housing 30 is provided with a pair of opposed snap ring finger-receiving slots 31 and 32 therethrough.

As shown in FIGS. 3, 4 and 10, a weighted aluminum cartridge member 33 is slidably mounted within the barrel housing 30. A pair of opposed elongate longitudinally oriented snap ring finger seating recesses 34 and 35 are longitudinally provided along the outer surface of the cartridge member 31. A pair of elongate resilient outwardly curved snap ring-engaging finger members 36 and 37, respectively, are pivotally mounted within the corresponding snap finger receiving recesses 34 and 35, respectively. The snap finger members 36 and 37 are pivotally connected at one end thereof to the cartridge member 33 by use of transverse snap-finger connector spring pins 38 and 39 as shown in FIGS. 4 and 10. As further specifically shown in FIG. 4, a transversely positioned snap finger expander spring 40 is positioned within a transverse bore provided through the upper end portion of the cartridge member 33. Thus positioned, the expander spring 38 acts upon the outwardly curved free ends of the snap ring-engaging fingers 36 and 37 to maintain them in opposed outwardly extending positions as shown in FIGS. 3 and 4. Thus positioned, the free ends of the snap ring-engaging fingers 36 and 37 extend outwardly through the snap ring-engaging finger receiving slots 31 and 32 provided in the barrel housing 30 when the cartridge member 33 is in its upper rest position within the barrel housing 38 as shown in FIG. 3. Thus positioned, the free ends of the snap fingers 34 and 35 act to retain the snap ring 41 in its upper rest position on the upper portion of the external surface of the barrel housing 30, proximate to the collar 26 as shown in FIGS. 3 and 4. The snap ring 41 is slidably mounted on the barrel housing 33 and is free to slidably move rapidly along the outer surface of the barrel housing 33 when released by the snap fingers as will be hereinafter described. A shock-absorber pad 42 is provided at the upper end of the cartridge member 33. The shock absorber pad 42 can be made of felt, cork or any other type of resilient matter known in the art.

The snap ring 41 is chromed so as to be resistant to every type of inclement weather. The barrel housing 33, cartridge member 33 and collar 26 are fabricated from aluminum or any other appropriate materials so as to also be weatherproof.

As shown in FIGS. 3 and 10, a main compression spring 43 is mounted within the barrel housing 30. In the preferred embodiment of the invention, the main compression spring 43 is five inches long with six coils per inch throughout. The diameter of the coils is ½ inch and the wire thickness is 1/16 inch.

The main compression spring 43 is maintained in its operative use position within the barrel housing 30 by use of an adjustable head closure member 44 which is in threadable engagement with the lower threaded end of the barrel housing 30. The upper end of the main compression spring 43 is configured to seatably engage and bear against an upper cartridge-engaging locator bearing 45. The lower end of the main compression spring 43 is configured to seatably engage a lower adjustable head closure member-engaging spring locator bearing 46, respectively.

Thus positioned, the lower locator bearing 46 engages the conical internal end surface 47 of the adjustable head closure member 44 and the upper locator bearing 45 engages the lower end surface of the cartridge member 33. The main compression spring 43 acts against the lower end of the cartridge member 33 so as to maintain it in its upper rest position within the barrel housing 30, as shown in FIG. 3. As stated previously, with the cartridge member 33 thus positioned within the barrel housing 30, the free ends of the snap ring-engaging fingers 36 and 37 extend outwardly through the barrel housing slots 31 and 32 so as to engage the snap ring 41 in its upper rest position on the barrel housing 30 against the collar member 26 as shown in FIGS. 3 and 4.

With the mechanical head assembly 23 thus assembled and affixed to the flexible shaft 21, a unique and effective golf swing training device and exerciser is provided to enable a golfer to improve and perfect his golf swing.

When the golf swing training device is swung properly with correct hand action, the resultant centrifugal force causes the weight cartridge member 33 to move downwardly within the barrel housing 30 so as to compress the main compression spring 43. The downward movement of the cartridge 33 within the barrel housing 30 causes the snap ring-engaging fingers 36 and 37 to engage the lower ends of the slots 31 and 32 and thus retract within the barrel housing 30, as shown in FIG. 10. When the snap ring-engaging fingers 36 and 37 retract sufficiently, the snap ring 41 is released and in response to the same centrifugal force slidably proceeds downwardly along the outer surface of the barrel housing 30 at a high rate of speed until it collides with the end of the head housing as shown in FIG. 10. The collision produces a loud snap noise and, in addition, produces a physical feeling as if a golf club had struck a golf ball.

For purposes of illustration, the snap ring 41 is shown in phantom line in FIG. 10 to illustrate an interim position on the barrel housing 30 as it moves downwardly to collide with the upper edge of the adjustable head closure member 44 as described herein.

The adjustable head closure member 44 can be threadably adjusted so as to increase the tension on the main spring so that it requires more force, actually faster hand action, to produce the desired effect. As shown in FIG. 1, spring tension indicator indicia 48 are provided on the external surface of the lower portion of the barrel housing 30 so as to cooperate with the upper edge of the adjustable head closure member 44 so as to give a visual indication spring tension that has been selected by the golfer.

After extensive testing and redesign of the precision components of this device, a golf club training device is provided which enables a golfer to have the actual experience of a full complete release of the hands through the hitting area for a novice or a touring pro. If a golfer fails to use his or her hands properly they do not generate sufficient club head speed for the snap fingers to retract and release the snap ring. In other words, nothing happens. Although the teaching of proper hand action is the main purpose of the golf club training device, it has many other benefits. It has been designed so that it can be swung indoors to allow year round practice of the golf swing. In order to get the desired results the golfer must do several things properly as he swings. The golf club training device strengthens golf muscles and builds muscle memory. It allows him to work on his swing tempo and timing. For a golf instructor it is the teaching aid that allows him to actually show a student how to do it correctly instead of merely telling them how.

In summary, a golf swing training device is provided for use by golf instructors and golfers. The golf swing training device comprises a flexible hollow golf club shaft which is provided with a golf club hand grip at the upper end of the shaft, a mechanical head assembly fixedly connected to the lower end of the shaft by use of shaft connector assembly means. The mechanical head assembly comprises a barrel housing having a pair of opposed snap ring-engaging finger receiving slots provided therethrough. A weighted spring biased cartridge member is slidably mounted within the barrel housing and is provided with a pair of opposed pivotally mounted outwardly curved spring-biased snap ring-engaging fingers. The snap ring-engaging fingers extend through the finger receiving slots when the cartridge member is in its upper rest position within the barrel housing. A main compression spring is provided within the barrel housing in operative engagement with the lower end of the weighted cartridge member so as to maintain the weighted cartridge member in its upper rest position within the barrel housing. The main compressing spring is in operative engagement with an upper cartridge-engaging locator bearing at the upper end thereof. The main compression spring is also in operative engagement with a lower adjustable head-engaging locator bearing at the lower end thereof. An adjustable head closure member is provided in threaded closure engagement with the lower end of the barrel housing. The adjustable head closure member is in positive stable engagement with the lower adjustable head-engaging locator bearing so as to selectively vary the tension of the main compression spring by selective threaded adjustment of the adjustable head closure member in relation to the barrel housing. A snap ring member is slidably provided on the external surface of the barrel housing and is retained in its upper rest position on the barrel housing by the ends of the snap ring-engaging fingers extending through the finger receiving slots. The snap ring is selectively releasable to rapidly slide downwardly along the barrel housing into snap sound-engaging contact with the upper edge of the adjustable head closure member when the centrifugal force created by the properly executed swing of the golf club training device causes the weighted cartridge member to move downwardly within the barrel housing so as to retract the snap fingers within the barrel housing upon contact with the lower edges of the longitudinal slots thereby releasing the snap ring to also move downwardly in response to the centrifugal force created by the properly executed swing so as to strikably engage the upper edge of the adjustable head closure member to impart a simulated feel and sound of a properly struck golf ball to the golfer.

The shaft connector assembly comprises a collar member having a shaft-receiving bore therethrough which is adapted for press-fit engagement with the hollow shaft positioned therethrough. A longitudinally oriented expander pin is provided in press-fitted engagement within the lower end of the hollow shaft so as to expand the hollow shaft into fixed positive engagement with the interior of the collar member. The collar member is configured to define a lower downwardly extending narrow neck portion adapted for press-fit engagement within the upper interior end of the barrel housing. A transverse spring pin positioned within a diametral transverse bore through the barrel housing, the neck portion of the collar member, the hollow shaft and the expander pin so as to maintain the barrel housing, the collar member, the hollow shaft and the expander pin in permanent fixed mating engagement.

The weighted cartridge member is provided with a transversely positioned snap ring-engaging finger expander spring therethrough. The expander spring is adapted to act upon the ends of the opposed snap ring-engaging fingers so as to selectively maintain them in their expanded position through the longitudinal slots provided through the barrel housing. The expander spring is selectively compressible so as to permit the snap ring-engaging fingers to retract within the barrel housing when the weighted cartridge member moves downwardly within the barrel housing in response to centrifugal force created by the properly executed swing of the golf swing training device.

The adjustable head closure member is provided with an internal conical lower spring locator bearing-engaging surface which is adapted to stabilizingly engage the lower spring locator bearing so as to maintain the main compression spring in a stable position within the barrel housing. A safety loop wrist strap is provided at the top of the golf club hand grip so as to selectively encircle the wrist of a golfer during the use of the golf swing training device.

Spring tension indicator indicia are provided along the lower exterior surface of the barrel housing which are adapted to cooperate with the upper edge of the adjustable head closure member to give a visual indication of the selective threaded adjustment of the adjustable head closure member so as to selectively vary the tension of the main compression spring.

Various other modifications of the invention may be made without departing from the principle thereof. Each of the modifications is to be considered as included in the hereinafter appended claims, unless these claims by their language expressly provide otherwise.

I claim:

1. In a golf swing training device for use by golf instructors and golfers comprising:

a flexible hollow golf club shaft, said shaft provided with a golf club hand grip at the upper end thereof;

a mechanical head assembly fixedly connected to the lower end of said shaft by use of shaft connector assembly means, said mechanical head assembly comprising:

a barrel housing having a pair of opposed snap ring-engaging finger receiving slots provided therethrough;

a weighted spring biased cartridge member slidably mounted within said barrel housing, said weighted cartridge member provided with a pair of opposed pivotally mounted outwardly curved spring-biased snap ring-engaging fingers, said snap ring-engaging fingers extending through said finger receiveing slots when said cartridge member is in its upper rest position within said barrel housing;

an upper spherical cartridge-engaging locator bearing provided within said barrel housing being in operative engagement with the lower end of said weighted cartridge member;

a main compression spring provided within said barrel housing in operative engagement with said upper locator bearing to maintain said weighted cartridge member in its upper rest position within said barrel housing, said main compression spring being in operative engagement with said upper cartridge-engaging locator bearing at the upper end thereof;

a lower spherical locator bearing provided within said barrel housing being in operative engagement with the lower end of said main compression spring;

an adjustable head closure member provided in threaded closure engagement with the lower end of said barrel housing and having an upper edge adjacent the external surface of the barrel housing and having an upper edge adjacent the external surface of the barrel housing, said adjustable head closure member being in positive engagement with said lower spherical locator bearing so as to selectively vary the tension of said main compression spring by selective threaded adjustment of said adjustable head closure member in relation to the barrel housing; said shaft connector assembly means comprising:

a collar member having a shaft-receiving bore therethrough which is adapted for press-fit engagement with said hollow shaft positioned therethrough;

a longitudinally oriented expander pin in press-fitted engagement within the lower end of said hollow shaft so as to expand said hollow shaft into fixed positive engagement with the interior of said collar member, said collar member defining a lower downwardly extending narrow neck portion adapted for press-fit engagement within the upper interior end of said barrel housing; and a transverse spring pin positioned within a diametral transverse bore through said barrel housing, said neck portion of said collar member, said hollow shaft and said expander pin so as to maintain said barrel housing, said collar member, said hollow shaft and said expander pin in permanent fixed mating engagement; and a snap ring member slidably provided on the external surface of said barrel housing, said snap ring member retained in its upper rest position on said barrel housing by the ends of said snap ring-engaging fingers extending through said finger receiving slots, said snap ring selectively releasable to rapidly slide downwardly along said barrel housing into snap sound-engaging contact with the upper edge of said adjustable head closure member when the centrifugal force created by the properly executed swing of the golf club training device causes said weighted cartridge member to move downwardly within the barrel housing so as to retract said snap fingers within said barrel housing upon conatct with the lower edges of said longitudinal slots, thereby releasing said snap ring to also move downwardly in response to the centrifugal force created by the properly executed swing so as to strikably engage the upper edge of said adjustable head closure member to impart a simulated feel and sound of a properly struck golf ball to the golfer.

2. In the golf swing training device of claim 1 wherein said weighted cartridge member is provided with a transversely positioned snap ring-engaging finger expander spring therethrough, said expander spring adapted to act upon the ends of said opposed snap ring-engaging fingers so as to selectively maintain them in their expanded position through said longitudinal slots provided through said barrel housing, said expander spring being selectively compressible so as to permit said snap ring-engaging fingers to retract within said barrel housing when said weighted cartridge member moves downwardly within said barrel housing in response to centrifugal force created by the properly executed swing of said golf swing training device.

3. In the golf swing training device of claim 1 wherein said adjustable head closure member is provided with an internal conical lower spring locator bearing-engaging surface, said conical surface adapted to stabilizingly engage said lower spring locator bearing so as to maintain said main compression spring in a stable position within said barrel housing.

4. In the golf swing training device of claim 1 wherein a safety loop wrist strap is provided at the top of said golf club hand grip so as to selectively encircle the wrist of a golfer during the use of said golf swing training device.

5. In the golf swing training device of claim 1 wherein spring tension indicator indicia are provided along the lower exterior surface of the barrel housing, said indicia adapted to cooperate with the upper edge of the adjustable head closure member to give a visual indication of the selective threaded adjustment of the adjustable head closure member so as to selectively vary the tension of said main compression spring.

* * * * *